US010744548B2

(12) United States Patent
Kitamura

(10) Patent No.: US 10,744,548 B2
(45) Date of Patent: Aug. 18, 2020

(54) STAMPING DEVICE

(71) Applicant: Toyota Jidosha Kabushiki Kaisha, Toyota-shi Aichi-ken (JP)

(72) Inventor: Yoshitsugu Kitamura, Toyoake (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 169 days.

(21) Appl. No.: 15/908,027

(22) Filed: Feb. 28, 2018

(65) Prior Publication Data

US 2018/0257123 A1 Sep. 13, 2018

(30) Foreign Application Priority Data

Mar. 7, 2017 (JP) ..... 2017-042901

(51) Int. Cl.
*B21D 22/08* (2006.01)
*B21D 22/04* (2006.01)
*B21D 13/04* (2006.01)

(52) U.S. Cl.
CPC ..... *B21D 22/08* (2013.01); *B21D 13/04* (2013.01); *B21D 22/04* (2013.01)

(58) Field of Classification Search
CPC ..... B21D 22/08; B21D 22/04; B21D 22/06; B21D 13/02; B21D 13/04; B21D 13/08; B21D 28/02; B21D 28/12; B21D 17/02; B21D 17/04; B41J 3/385; B41K 3/10; B41K 3/08; B41K 3/32; B41K 3/36; A21C 11/04; A23G 3/0023; A43D 8/22
See application file for complete search history.

(56) References Cited

U.S. PATENT DOCUMENTS 3,116,820 A * 1/1964 Owen ..... B41J 3/38 400/134
2010/0043511 A1* 2/2010 Forsyth ..... B21D 25/00 72/18.1

(Continued)

FOREIGN PATENT DOCUMENTS

JP H05338394 A 12/1993
JP H08174987 A 7/1996
JP 2808234 B2 10/1998

(Continued)

OTHER PUBLICATIONS

United States Tariff Commission, Summaries of Tariff Information, 1950, United States Tariff Commission, vol. 16, p. 280 (Year: 1950).*

(Continued)

*Primary Examiner* — Adam J Eiseman
*Assistant Examiner* — Dylan Schommer
(74) *Attorney, Agent, or Firm* — Dinsmore & Shohl LLP

(57) ABSTRACT

A stamping device has: a die seat that a metal sheet, as a workpiece, abuts; and a stamping punch configured to stamp a character to be stamped onto a front surface of the metal sheet by pressing the stamping punch onto a stamped region of the metal sheet from the front surface side of the metal sheet. A stamp-receiving region that corresponds to the stamped region is provided on a front surface of the die seat, and, in this stamp-receiving region, plural dents are provided in such a manner as to correspond to the stamped region of the single character to be stamped.

10 Claims, 9 Drawing Sheets

(56) References Cited

U.S. PATENT DOCUMENTS

| | | | | |
|---|---|---|---|---|
| 2010/0083728 | A1* | 4/2010 | Morales | B21D 22/02 72/412 |
| 2016/0279687 | A1* | 9/2016 | Thomas | B21D 22/04 |

FOREIGN PATENT DOCUMENTS

| | | | | |
|---|---|---|---|---|
| JP | 2001305951 | A | * | 11/2001 |
| JP | 2001305951 | A | | 11/2001 |
| JP | 2007015150 | A | | 1/2007 |
| JP | 2012020499 | A | | 2/2012 |
| JP | 2012-236279 | A | | 12/2012 |

OTHER PUBLICATIONS

Printy, Manual Metallic Stamping Machine, May 16, 2012, Printy (Year: 2012).*

* cited by examiner

STAMPING DEVICE

CROSS-REFERENCE TO RELATED APPLICATIONS

This application claims priority to Japanese Patent Application No. 2017-042901 filed on Mar. 7, 2017, which is incorporated herein by reference in its entirety including the specification, drawings and abstract.

BACKGROUND

1. Technical Field

The disclosure relates to a stamping device.

2. Description of Related Art

Conventionally, as disclosed in Japanese Patent Application Publication No. 2007-15150 (JP 2007-15150 A), a vehicle identification number is stamped on each vehicle body at an automobile manufacturing plant. This vehicle identification number is not only used for production management, but is also used to identify a vehicle owner, a stolen vehicle, and the like after a vehicle is sold. Thus, the vehicle identification number has an important identification function. In view of this importance, several conditions are imposed on stamping of the vehicle identification number. An example of the conditions is that stamped characters and the like (including stamped letters, numbers, and symbols, and hereinafter referred to as stamped characters) each have to be clear and in stamped depth that is equal to or greater than a specified dimension in its entirety.

In general, stamping is a processing method of pressing a stamping punch with an inverse letter, number, symbol, or the like protruding from a tip surface onto a body panel to plastically deform a portion of a front surface of the body panel, and thereby transferring the letter, number, symbol, or the like (hereinafter referred to as a stamp character) on the stamping punch onto the body panel surface in a dented manner.

SUMMARY

For purposes of improved rigidity and reduced weight of the vehicle body, use of a high-tensile steel sheet (so-called a high-tensile material) as the body panel has been increased in recent years. In order to clearly stamp the character to be stamped onto this high-tensile steel sheet such that the stamped character has the stamped depth equal to or greater than the specified dimension, the stamping punch has to be pressed onto the high-tensile steel sheet with a high applied pressure.

When stamping is done with such a high applied pressure, wear or breakage (stamp chipping) of the stamp character, which protrudes from the tip surface of the stamping punch, is concerned. This wear or breakage, if it happens, leads to a difficulty in obtaining the clear stamped character and thus requires replacement of the stamping punch. In other words, long-time use of the stamping punch becomes difficult.

The inventor of the present disclosure has investigated a reason why the high applied pressure is required. The inventor of the present disclosure has focused on the following point: as shown in FIG. 10 (a cross-sectional view illustrating a state where stamping work is performed on a body panel a), in the case where the body panel (the high-tensile steel sheet) a as a workpiece is placed on a die seat b having a flat front surface and is stamped, a metal material is concentrated in a region where stress is generated by pressing of a stamping punch c (a dotted region in FIG. 10), which hinders plastic deformation of the body panel a and thus requires the high applied pressure.

Also, in the case where a general steel sheet is used rather than the high-tensile steel sheet, lowering of the applied pressure effectively extends a lifespan of the stamping punch.

The disclosure provides a stamping device capable of lowering an applied pressure that is required to obtain a stamped character in stamped depth equal to or greater than a specified dimension.

An aspect of the disclosure relates to a stamping device. The stamping device includes: a die seat that a metal sheet, as a workpiece, abuts; and a stamping punch configured to stamp a character to be stamped onto a front surface of the metal sheet by pressing the stamping punch onto a stamped region of the metal sheet from the front surface side of the metal sheet. In this stamping device, a stamp-receiving region that corresponds to the stamped region is provided on a front surface of the die seat, and, in this stamp-receiving region, plural dents are provided in such a manner as to correspond to the stamped region of the character to be stamped.

In the above aspect, in the cases where the metal sheet abuts the front surface of the die seat and the character to be stamped (a letter, a number, a symbol, and the like to be stamped) is stamped by pressing the stamping punch onto the stamped region of this metal sheet from the front surface side of the metal sheet, a portion of a material of the metal sheet that is dented by the stamping punch protrudes into the dent of the die seat. In this way, a degree of concentration of a metal material is lowered. For this reason, an applied pressure that is required to obtain the stamped character in stamped depth that is equal to or greater than a specified dimension can be set low. As a result, wear or breakage of the stamping punch can be suppressed. Thus, a lifespan of the stamping punch can be extended. Since the plural dents are provided in such a manner as to correspond to the stamped region of the stamped character, the degree of the concentration of the metal material can be lowered for any of the stamped characters (regardless of a type of the stamped character). Thus, the applied pressure that is required to obtain the stamped character in the stamped depth equal to or greater than the specified dimension can be set low.

In the case where a plurality of the characters to be stamped is stamped onto the front surface of the metal sheet, the stamped region of the metal sheet may be a region where the plurality of the characters to be stamped is stamped. In a front view of the front surface of the die seat in a state where the metal sheet abuts the front surface of the die seat, the stamp-receiving region of the die seat may be defined as a region having an outer edge that is located on an outer side of an outer edge of the stamped region by a specified dimension.

According to this configuration, on the front surface of the die seat, the plural dents are provided in the larger area than the stamped region of the metal sheet. Thus, even when a pressing position of the stamping punch toward the stamped region of the metal sheet is offset, the portion of the material of the metal sheet can protrude into the dent (enter the dent) for the entire stamped character. In this way, the degree of the concentration of the metal material can be lowered. That is, even when the pressing position of the stamping punch is offset, the applied pressure that is required to obtain the stamped character in the stamped depth equal to or greater than the specified dimension can be set low.

Each of the dents may have a circular shape in the front view of the front surface of the die seat. A diameter of each of the dents may be smaller than half a height dimension of the character to be stamped. The dents may be arranged such that the adjacent dents do not overlap each other.

According to this configuration, the applied pressure that is required to obtain the stamped depth equal to or greater than the specified dimension can be set low for any of the characters to be stamped. In addition, because a portion that supports the metal sheet (restricts deformation caused by pressing of the stamping punch) exists between the adjacent dents, the metal sheet is suppressed from being deformed more than necessary.

The diameter of each of the dents may have a value that is within a range from ⅓ to 1/12 of the height dimension of the character to be stamped. A spacing dimension between the adjacent dents may be set to have a smaller value than the diameter.

Furthermore, the diameter of each of the dents may have a value that is within a range from ¼ to 1/10 of the height dimension of the character to be stamped. The spacing dimension between the adjacent dents may be set to have the smaller value than the diameter.

According to these configurations, in the stamp-receiving region of the front surface of the die seat, a large number of the dents can be provided in such a manner as to correspond to the stamped region of the stamped character. Thus, an amount of the protrusion of the metal material into the dent (an amount of the metal material entering the dent) can be suppressed from being locally increased. Therefore, the metal sheet is suppressed from being deformed more than necessary.

Each of the dents may have a conical shape.

In the disclosure, in the stamp-receiving region of the front surface of the die seat that the metal sheet as the workpiece abuts, the plural dents are provided in such a manner as to correspond to the stamped region of the character to be stamped. Thus, when the front surface of the metal sheet is stamped, the portion of the material of the metal sheet that is dented by the stamping punch protrudes into the dent of the die seat. In this way, the degree of the concentration of the metal material is lowered. For this reason, the applied pressure that is required to obtain the stamped character in the stamped depth equal to or greater than the specified dimension can be set low. As a result, wear or breakage of the stamping punch can be suppressed. Thus, the lifespan of the stamping punch can be extended.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

A description will hereinafter be made on an embodiment of the disclosure on the basis of the drawings. In this embodiment, a case where the disclosure is applied as a stamping device used to stamp a vehicle identification number on a body panel of an automobile will be described.

—Schematic Configuration of Stamping Device—

First, a schematic configuration of the stamping device according to this embodiment will be described.

Figure 1:
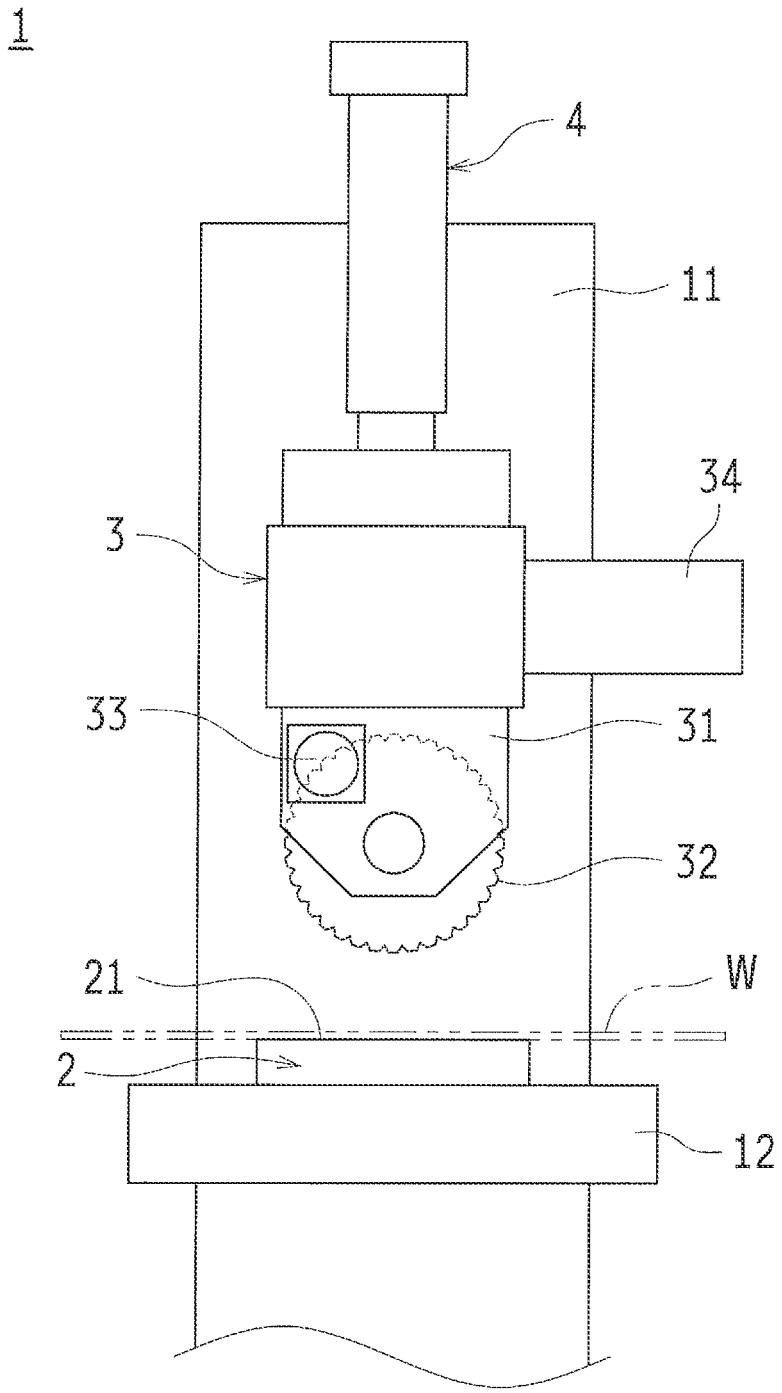
FIG. 1 is a front view of a stamping device according to an embodiment.
Figure 2:
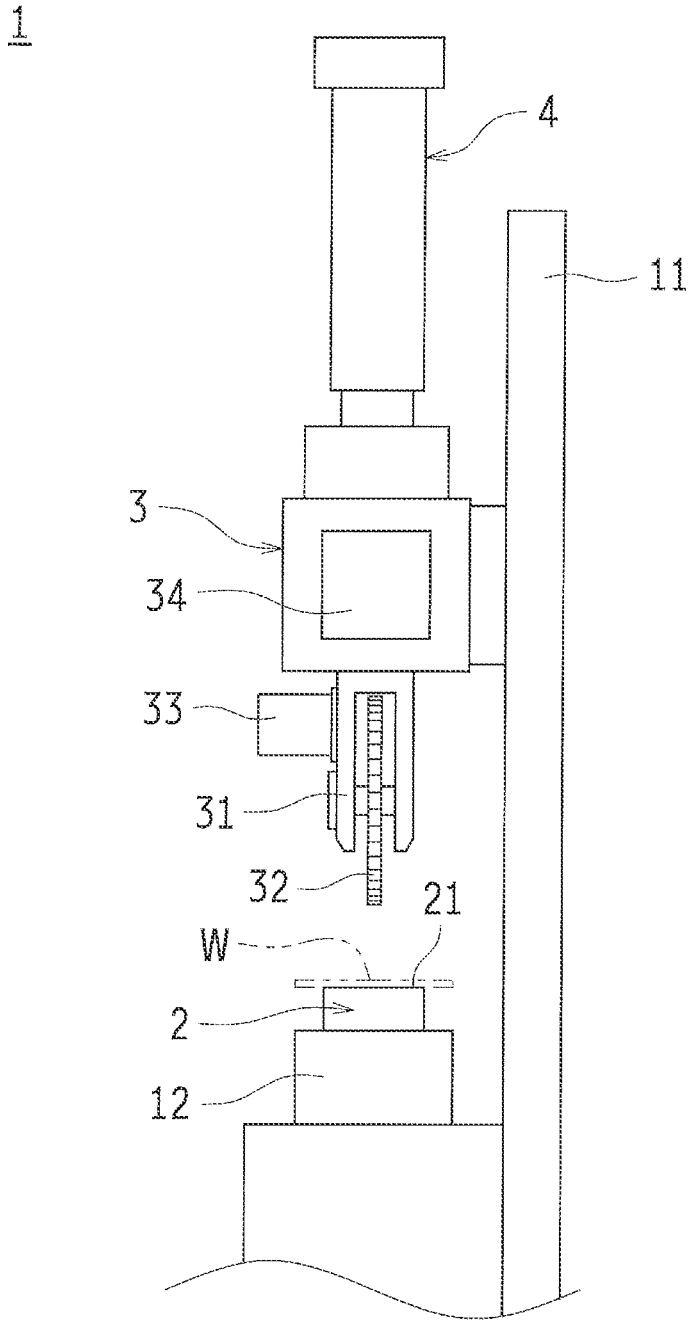
FIG. 2 is a side view partially illustrating the stamping device according to the embodiment.

FIG. 1 is a front view of a stamping device 1 according to this embodiment. FIG. 2 is a side view partially illustrating the stamping device 1 according to this embodiment. As shown in these drawings, the stamping device 1 includes a device main body 11, a die seat 2 which a body panel W as a workpiece (the metal sheet in the disclosure, indicated by an imaginary line in FIG. 1 and FIG. 2) is placed on (abuts), a stamping unit 3 that stamps the body panel W, a stamping pressuring unit 4 that raises or lowers the stamping unit 3.

The die seat 2 is a metallic member in a substantially rectangular parallelepiped shape, and is fixed to a placement table 12 provided in the device main body 11. When stamping work is performed, the body panel W is placed on an upper surface (a front surface) 21 of the die seat 2. Characteristics of this die seat 2 will be described later.

The stamping unit 3 is configured that a character ring 32 is supported by a unit main body 31 in a freely rotatable manner about a horizontal axis. Plural types of letters, numbers, symbols, and the like (stamp characters) that are stamped on the body panel W are formed on an outer circumferential surface of the character ring 32 in such a manner as to protrude therefrom. When any of these protruding stamp characters is pressed onto the front surface of the body panel W, the body panel W is stamped. Thus, this character ring 32 has a function of the stamping punch.

The unit main body 31 can freely move in a horizontal direction (a right-left direction in FIG. 1) by a digit forwarding mechanism 34 that includes a ball screw and the like. A movement direction of this unit main body 31 corresponds to a longitudinal direction of the die seat 2, which is fixed onto the placement table 12.

The stamping unit 3 further includes a character forwarding motor 33. The character forwarding motor 33 rotates the character ring 32, selects the character to be stamped from the stamp characters, which protrude from the outer circumferential surface of this character ring 32, and causes the character to be stamped to face the body panel W. More specifically, the character forwarding motor 33 is subjected to feedback control on the basis of a confirmed rotation position of this character ring 32, and rotates the character ring 32 to cause the character to be stamped to face the body panel W.

The stamping pressuring unit 4 raises or lowers the stamping unit 3. When stamping pressuring unit 4 lowers the stamping unit 3, the character ring 32 is pressed onto the body panel W with a specified applied pressure, and this body panel W is held between the character ring 32 and the die seat 2. In this way, the character to be stamped (a dent in which the stamp character is transferred) is stamped on the front surface of the body panel W.

—Die Seat—

Figure 3:
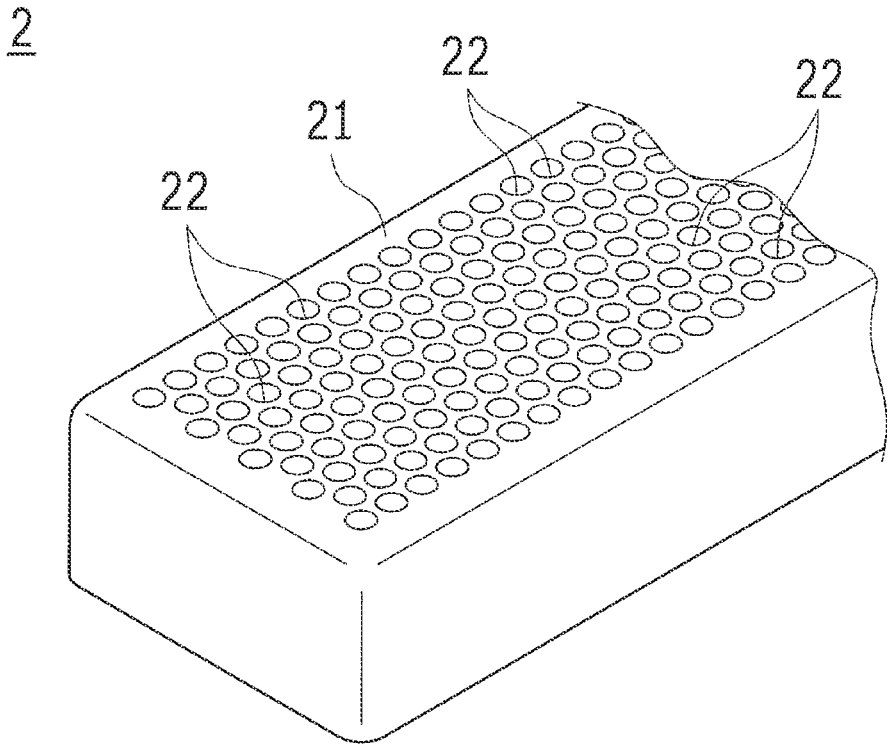
FIG. 3 is a perspective view partially illustrating a die seat.
Figure 4:
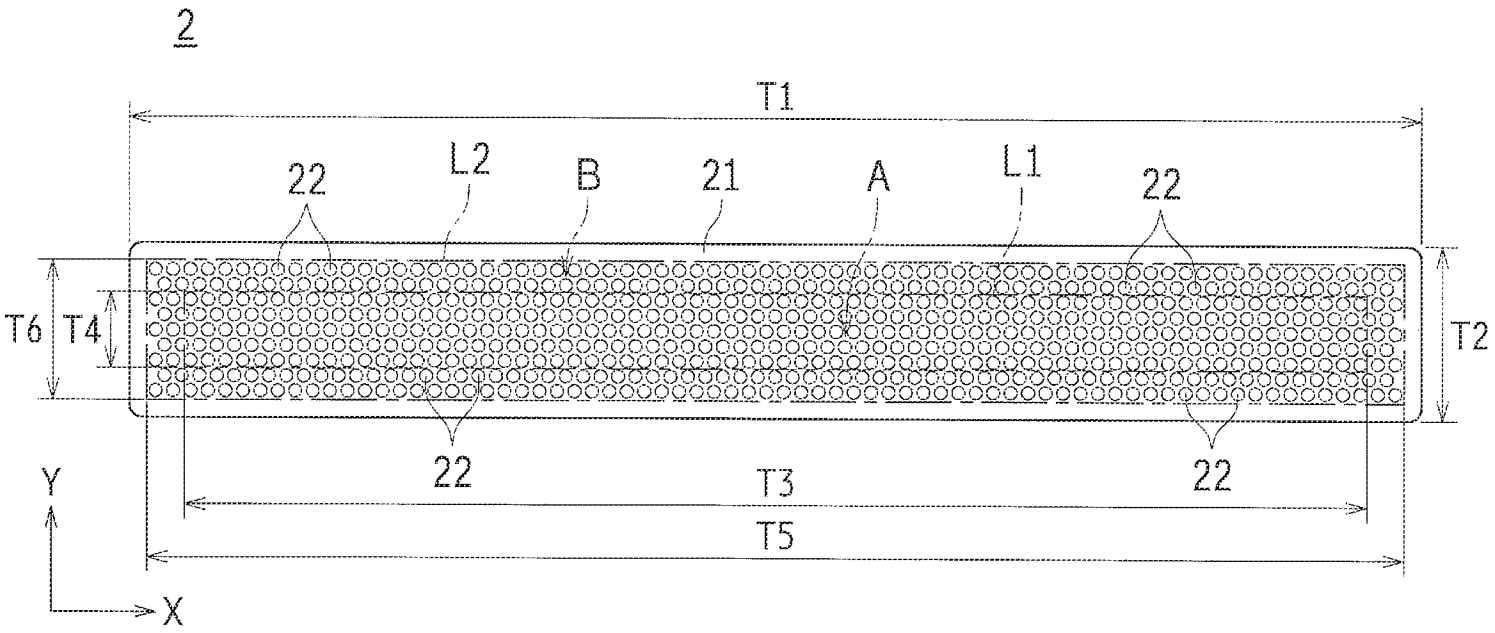
FIG. 4 is a plan view of the die seat.
Figure 5:
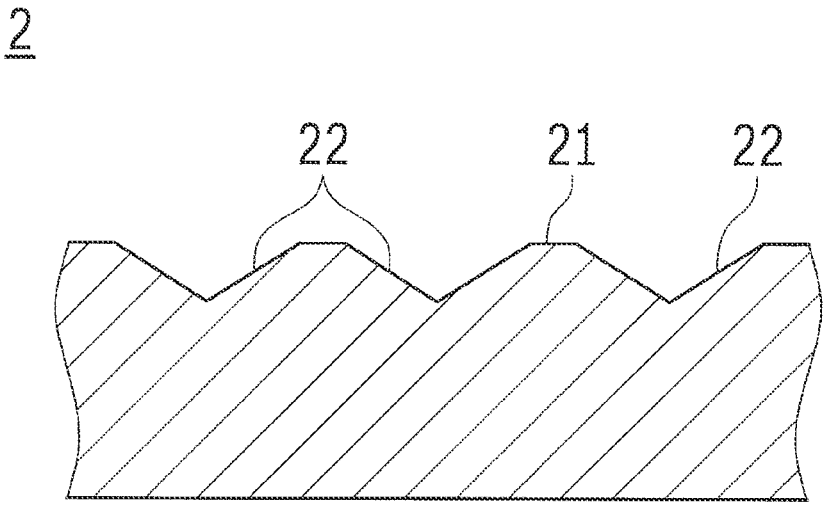
FIG. 5 is a cross-sectional view partially illustrating the die seat.

Next, the die seat 2 as a characteristic member in this embodiment will be described. FIG. 3 is a perspective view partially illustrating the die seat 2. FIG. 4 is a plan view of the die seat 2. FIG. 5 is a cross-sectional view partially illustrating the die seat 2.

As shown in FIG. 3 to FIG. 5, the die seat 2 has the substantially rectangular parallelepiped shape, and is formed of high-speed steel that has undergone nitriding treatment, for example. The upper surface 21 as a surface on which the body panel W is placed has Rockwell hardness HRC of approximately 50° to 70°. This upper surface 21 of the die seat 2 has a large number of dents (dimples) 22. The constituent materials of the die seat 2 are not limited to those described above.

More specifically, a length dimension (a dimension in the right-left direction (an X-direction) in FIG. 4) T1 and a width dimension (a dimension in an up-down direction (a Y-direction) in FIG. 4) T2 of the upper surface 21 of the die seat 2 are set to be greater than a length dimension T3 and a width dimension T4 of a region of the body panel W in which the vehicle identification number is stamped (a region in which the character to be stamped is stamped on the body panel W in a state where this body panel W is placed on the upper surface 21 of the die seat 2, a region surrounded by a one-dot chain line L1 in FIG. 4) A.

The length dimension T3 of the stamped region A is set to such a dimension that the characters in the specified digit number can be stamped in the stamped region A. For example, in the cases where the single character (the single stamped character) has a width dimension (a dimension in the X-direction) of 6 mm, the digit number of the stamped characters is 19, and a spacing dimension between the adjacent stamped characters is 2 mm, the length dimension T3 of this stamped region A is approximately 150 mm. In addition, the width dimension T4 of the stamped region A substantially corresponds to a height dimension (a dimension in the Y-direction) of one character. For example, in the case where the height dimension of the single character is 8 mm, the width dimension T4 of this stamped region A is approximately 8 mm.

The length dimension T1 of the upper surface 21 of the die seat 2 is set to be greater than the length dimension T3 by a specified dimension (is set to approximately 158 mm, for example). The width dimension T2 of the upper surface 21 of the die seat 2 is set to be greater than the width dimension T4 by a specified dimension (is set to approximately 20 mm, for example).

In a formation region (the stamp-receiving region B in the disclosure, a region surrounded by a one-dot chain line L2 in FIG. 4) of the large number of dents 22 that are provided on the upper surface 21 of the die seat 2, a length dimension T5 is set to be greater than the length dimension T3 of the stamped region A and is set to be slightly less than the length dimension T1 of the upper surface 21 of the die seat 2 (is set to approximately 156 mm, for example). In addition, a width dimension T6 of the formation region B is set to be greater than the width dimension T4 of the stamped region A and is set to be slightly less than the width dimension T2 of the upper surface 21 of the die seat 2 (is set to approximately 16 mm, for example). That is, the stamp-receiving region B of the die seat 2 is defined as a region, an outer edge of which is located on an outer side of an outer edge of the stamped region A by a specified dimension. This stamp-receiving region B is defined as a larger region than the stamped region A.

The dents 22, which are provided on the upper surface 21 of the die seat 2, each have a circular shape in a front view of the upper surface 21 of the die seat 2, for example. A diameter of each of the dents 22 is approximately 1.5 mm, and depth in the deepest section of each of the dents 22 is approximately 0.5 mm. These dents 22 are foiled by cutting the upper surface 21 of the die seat 2 using a cutting tool (for example, a drill). Thus, the dents 22 are each formed as a dent in a conical shape (a dent in a mortar shape) (see FIG. 5).

The dents 22 are arranged in a hounds-tooth check pattern on the upper surface 21 of the die seat 2. That is, in FIG. 4, in relation to a center position of each of the dents 22 on the lowest row (a row of the dents 22 arranged in the X-direction in the drawing; hereinafter referred to as a first row), a center position of each of the dents 22 on the second lowest row (positioned on an upper side of the first row in the Y-direction in the drawing) (hereinafter referred to as a second row) is offset in the X-direction (located in the middle in between the center positions of the adjacent dents 22, 22 on the first row). Just as described, the dents 22 are arranged in the hounds-tooth check pattern in which the center position of each of the dents 22 on the odd-numbered row from the lower side is offset in the X-direction in relation to the center position of each of the dents 22 on the even-numbered row from the lower side. In addition, the three dents that are adjacent to each other (the dent 22 that is adjacent to one of the dents 22 in the X-direction and the dent 22 that is diagonally adjacent to the one dent 22 in FIG. 4) are arranged such that the center positions thereof correspond to vertices of an equilateral triangle.

An exemplary pitch between the dents 22 in the X-direction is set to approximately 1.8 mm. That is, each of the dents 22 is formed at a position with the pitch such that the adjacent dents 22, 22 do not overlap each other.

The above-described numerical values are not restrictive and are appropriately set by an experiment or a simulation.

The followings are a description of the dents 22. A diameter of each of the dents 22 and the pitch between the dents 22 are set such that the plural dents 22 exist in the stamped region A of the single stamped character. Each of the dents 22 is independent from (is not connected to) the other dent(s) 22. In order to fulfill the above conditions, the diameter of each of the dents 22 has to be smaller than half the height dimension of the stamped character, and the dents 22 have to be formed with the pitch being defined between the adjacent dents 22 so that the adjacent dents 22 do not overlap each other. In some embodiments, the diameter of each of the dents 22 may have a value that falls within a range from ⅓ to 1/12 of the height dimension of the stamped character, and a spacing dimension between the adjacent dents 22 that may be set to have a smaller value than the diameter. In some embodiments, the diameter of each of the dents 22 has a value that falls within a range from ¼ to 1/10 of the height dimension of the stamped character, and the spacing dimension between the adjacent dents 22 is set to have the smaller value than the diameter. In some other embodiments, the diameter of each of the dents 22 has a value that falls within a range from ⅙ to ⅛ of the height dimension of the stamped character, and the spacing dimension between the adjacent dents 22 is set to have the smaller value than the diameter.

For example, the height dimension of the stamped character is 8 mm, and the width dimension of the stamped character is 6 mm as described above. When the diameter of each of the dents 22 is set to 0.8 mm, and the pitch between two each of the dents 22 is set to 1.0 mm, in the stamped region of the single stamped character, approximately six of the dents 22 exist in a width direction of the stamped character, and approximately eight of the dents 22 exist in a height direction of the stamped character. When the diameter of each of the dents 22 is set to 1.5 mm, and the pitch between two each of the dents 22 is set to 1.8 mm, in the stamped region of the single stamped character, approximately four of the dents 22 exist in the width direction of the stamped character, and approximately five of the dents 22 exist in the height direction of the stamped character. When the diameter of each of the dents 22 is set to 2.0 mm, and the pitch between two each of the dents 22 is set to 2.2 mm, in the stamped region of the single stamped character, approximately three of the dents 22 exist in the width direction of the stamped character, and approximately four of the dents 22 exist in the height direction of the stamped character.

With the above configuration, in the stamp-receiving region B provided on the upper surface 21 of the die seat 2, the plural dents 22 are provided in such a manner as to correspond to the stamped region A of the single stamped character.

Stamping Work

Next, the stamping work by the stamping device 1 using the die seat 2 will be described. In this stamping work, first, the body panel W is placed on the upper surface 21 of the die seat 2, which is fixed to the placement table 12 provided in the device main body 11.

In this state, the character forwarding motor 33 of the stamping unit 3 is actuated to rotate the character ring 32, selects the character to be stamped on the body panel W, and causes this selected character (the stamp character) to face the body panel W. Thereafter, when the stamping pressuring unit 4 is actuated to lower the stamping unit 3, the character ring 32 is pressed onto the body panel W with the specified applied pressure, and this body panel W is held between the character ring 32 and the die seat 2. In this way, the character to be stamped is stamped on the front surface of the body panel W. A magnitude of the applied pressure of this case is set in accordance with a type of the character to be stamped. More specifically, as the character to be stamped has a longer line, the higher applied pressure is set. In this way, sufficient stamped depth is acquired. For example, compared to a case where the character "I" is stamped, the high applied pressure is set to stamp the character "W".

Figure 6:
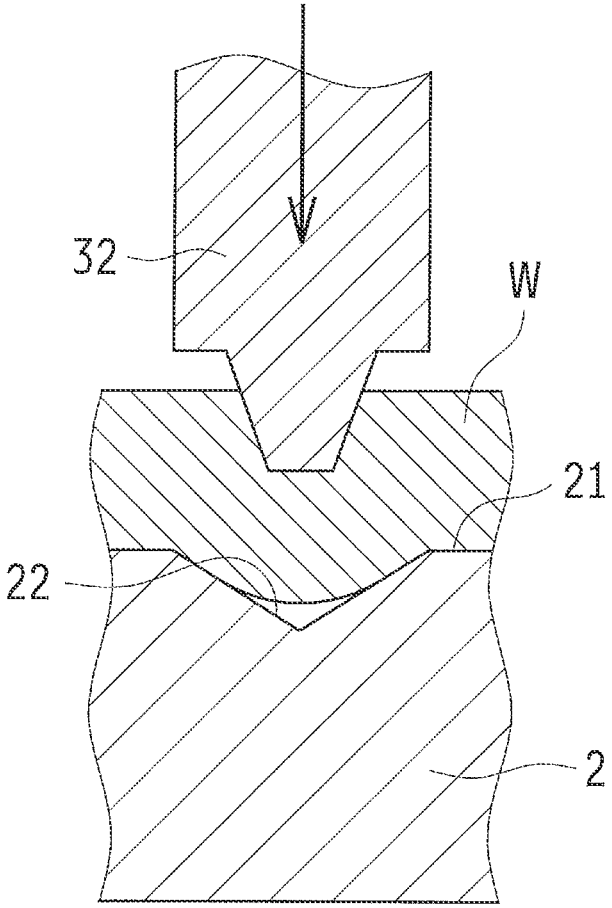
FIG. 6 is a cross-sectional view illustrating a state where stamping work is performed on a body panel in the embodiment.

At this time, as shown in FIG. 6 (a cross-sectional view illustrating a state where the stamping work is performed on the body panel W), a portion (a metal material) of the body panel W protrudes into the dent 22 (enters the dent 22), which is provided on the front surface of the die seat 2. In this way, a degree of concentration of the metal material of the body panel W is lowered. For this reason, the applied pressure that is required to obtain the stamped character in the stamped depth that is equal to or greater than the specified dimension can be low. That is, this applied pressure can be set low.

After one of the characters to be stamped is stamped, just as described, the stamping pressuring unit 4 raises the stamping unit 3. Then, the digit forwarding mechanism 34 moves the stamping unit 3 for one digit of the characters to be stamped along a longitudinal direction of the body panel W. In other words, the stamping unit 3 is forwarded for one digit. Thereafter, the character to be stamped next is selected, and the character ring 32 is rotated such that the character to be stamped next faces the body panel W. Then, the stamping unit 3 is lowered again. In this way, the character to be stamped is stamped onto the front surface of the body panel W. Also, in this case, as described above, the portion of the body panel W protrudes into the dent 22, which is provided on the front surface of the die seat 2. In this way, the degree of the concentration of the metal material of the body panel W is lowered. Thus, the applied pressure that is required to obtain the stamped character in the stamped depth equal to or greater than the specified dimension can be set low.

By repeating such an operation, a string of the characters in the specified digit number is stamped as the vehicle identification number on the front surface of the body panel W.

As it has been described so far, in this embodiment, when the character to be stamped is stamped, the portion of the body panel W protrudes into the dent 22, which is provided on the upper surface 21 of the die seat 2. In this way, the degree of the concentration of the metal material of the body panel W is lowered. For this reason, the applied pressure that is required to obtain the stamped character in the stamped depth that is equal to or greater than the specified dimension can be set low. As a result, wear or breakage of the stamp character (the character that protrudes from the outer circumferential surface of the character ring 32) can be suppressed. Thus, a lifespan of the character ring 32 can be extended.

Since the plural dents 22 are provided in such a manner as to correspond to the stamped region A of the single stamped character, the degree of the concentration of the metal material is lowered for any of the stamped characters (regardless of the type of the stamped character). Thus, the applied pressure that is required to obtain the stamped character in the stamped depth equal to or greater than the specified dimension can be set low. Note that, also in the case where the dent in the same shape as the stamped character is formed on the front surface of the die seat in accordance with the type of the stamped character, the degree of the concentration of the metal material is lowered. However, because the vehicle identification number differs by the vehicle body, the die seat has to be changed per vehicle body in this case. According to this embodiment, since it is configured that the plural dents 22 are provided on the upper surface 21 of the die seat 2, the degree of the concentration of the metal material can be lowered for any of the stamped characters. Thus, there is no need to change the die seat per vehicle body. Therefore, efficiency of stamping work of the unique vehicle identification number onto each of the plural vehicle bodies can be improved.

In this embodiment, since the stamp-receiving region B of the die seat 2 is defined as the region, the outer edge of which is located on the outer side of the outer edge of the stamped region A by the specified dimension, on the upper surface 21 of the die seat 2, the plural dents 22 are provided in the larger region than the stamped region A of the body panel W. Accordingly, even when a pressing position of the character ring 32 onto the stamped region A of the body panel W is offset, the body panel W can protrude into the dents 22 for the entire stamped character. In this way, the degree of the concentration of the metal material of the body panel W can be lowered. That is, even when the pressing position of the character ring 32 is offset, the applied pressure that is required to obtain the stamped character in the stamped depth that is equal to or greater than the specified dimension can be set low.

In this embodiment, the diameter of each of the dents 22 has the value that falls within the range from ¼ to 1/10 (in some other embodiments, the value that falls within the range from ⅙ to ⅛) of the height dimension of the stamped character, and the spacing dimension between the adjacent dents 22 is set to have the smaller value than the diameter. Accordingly, in the stamp-receiving region B of the upper surface 21 of the die seat 2, the large number of the dents 22 can be provided in such a manner as to correspond to the stamped region A of the single stamped character. Thus, an amount of the protrusion of the metal material into the dent 22 can be suppressed from being locally increased. Therefore, the body panel W is suppressed from being deformed more than necessary.

Experimental Example

Next, an experimental example that was implemented to confirm the above-described effects will be described. In this experimental example, the conventional die seat (the die seat with the flat upper surface) and three types of the die seat 2 according to the disclosure were used. In the three types of the die seats 2, the diameter of each of the dents 22 was 0.8 mm, 1.5 mm, and 2.0 mm. Stamping was performed with plural types of the applied pressure, and the stamped depth of each case was measured. In addition, the high-tensile steel sheet was used as the body panel W. The stamped depth was measured by using a dial indicator.

Figure 7:
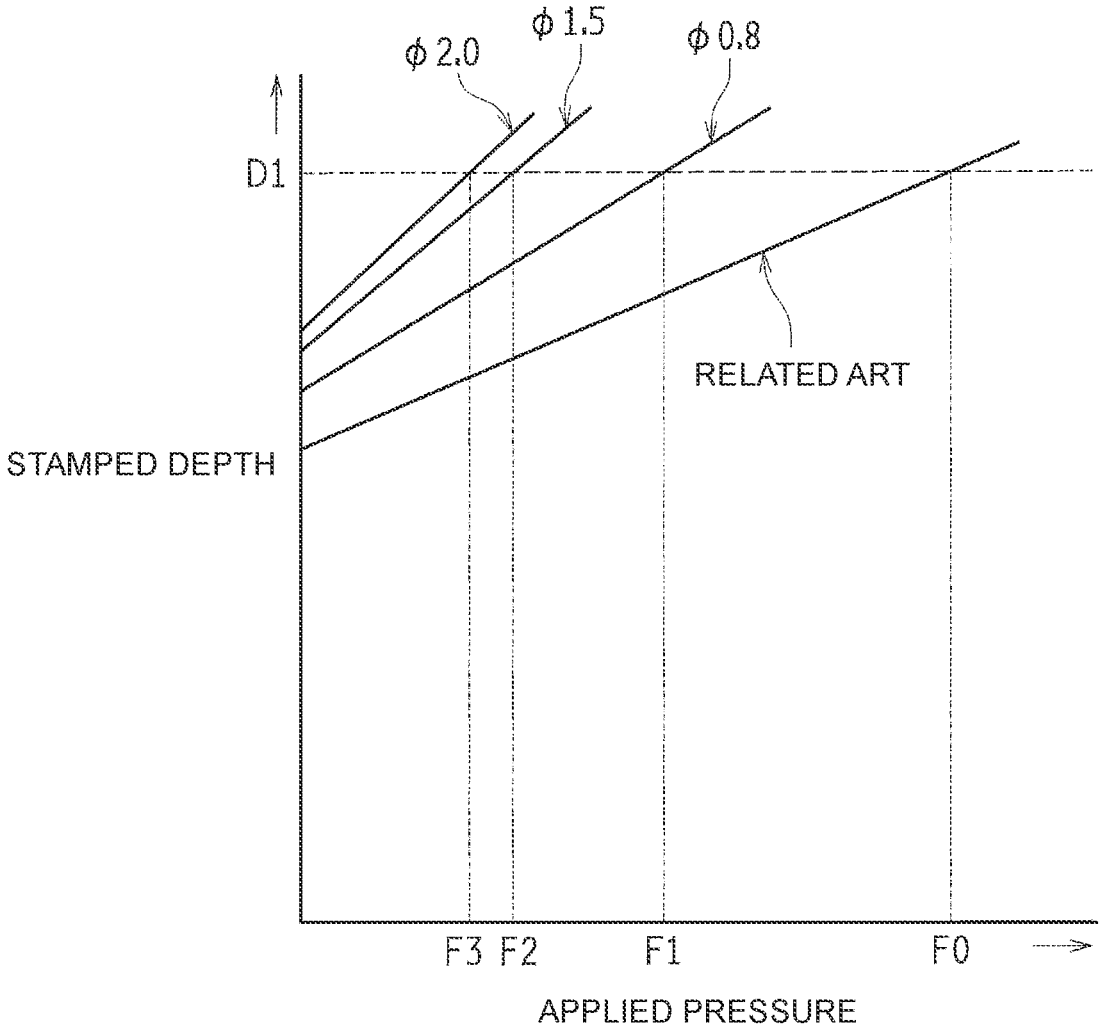
FIG. 7 is a graph illustrating a relationship between an applied pressure and stamped depth as results of an experimental example.

FIG. 7 is a graph illustrating a relationship between the applied pressure and the stamped depth as results of this experimental example. As it is apparent from this FIG. 7, in the case where the conventional die seat (the related art in FIG. 7) was used, the applied pressure that was required to form the stamped character in prescribed stamped depth (the stamped depth that is required to form the clear stamped character) D1 was F0 in the drawing, which was extremely high. Meanwhile, in this embodiment in which the dents 22 are provided on the upper surface 21 of the die seat 2, the applied pressure that was required to form the stamped character in prescribed stamped depth D1 was significantly lower than that in the related art. More specifically, when the diameter of each of the dents 22 was 0.8 mm (ϕ0.8 in FIG. 7), the applied pressure was F1 in the drawing. When the diameter of each of the dents 22 was 1.5 mm (ϕ1.5 in FIG. 7), the applied pressure was F2 in the drawing. When the diameter of each of the dents 22 was 2.0 mm (ϕ2.0 in FIG. 7), the applied pressure was F3 in the drawing. Thus, it was confirmed that, as the diameter of each of the dents 22 was increased, the required applied pressure was lowered.

First Modified Example

Next, a first modified example will be described. In this modified example, each of the dents 22 has a different shape from that in the above embodiment. However, the other configuration and the stamping work are the same as those in the above embodiment. Thus, only the shape of each of the dents 22 will be described herein.

Figure 8:
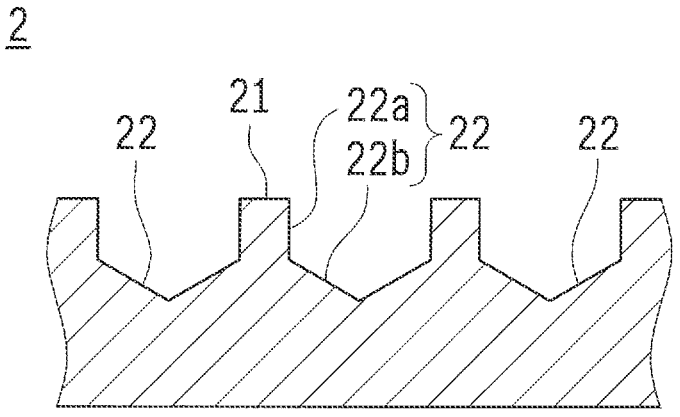
FIG. 8 is a view of a die seat in a first modified example corresponding to FIG. 5.

FIG. 8 is a cross-sectional view partially illustrating the die seat 2 in this modified example (a view corresponding to FIG. 5). As shown in this FIG. 8, the dents 22 in this modified example are also formed by cutting the upper surface 21 of the die seat 2 using the cutting tool (for example, the drill). Meanwhile, cutting depth by the cutting tool in cutting processing is set to be greater than that in the above embodiment. In this way, each of the dents 22 in this modified example has a columnar opening 22*a* and a dent 22*b* in the conical shape.

The same operational effects (that the applied pressure required to obtain the stamped character in the stamped depth that is equal to or greater than the specified dimension can be set low, and that wear or breakage of the stamp character can be suppressed) as those in the above embodiment can be obtained by the die seat 2 that includes the dents 22 in such shapes. In addition, the degree of the concentration of the metal material is lowered for any of the stamped characters. Thus, the applied pressure that is required to obtain the stamped character in the stamped depth equal to or greater than the specified dimension can be set low.

Second Modified Example

Next, a second modified example will be described. Also in this modified example, each of the dents 22 has a different shape from that in the above embodiment. However, the other configuration and the stamping work are the same as those in the above embodiment. Thus, only the shape of each of the dents 22 will be described herein.

Figure 9:
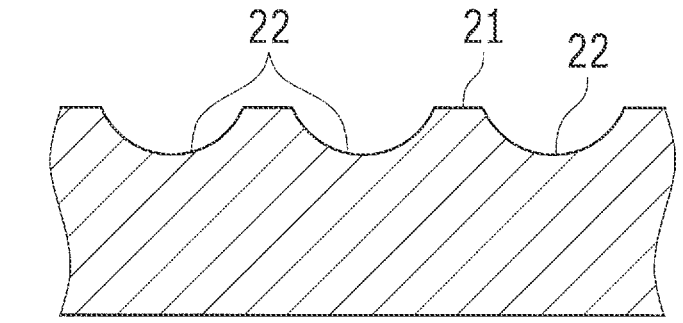
FIG. 9 is a view of a die seat in a second modified example corresponding to FIG. 5.
Figure 10:
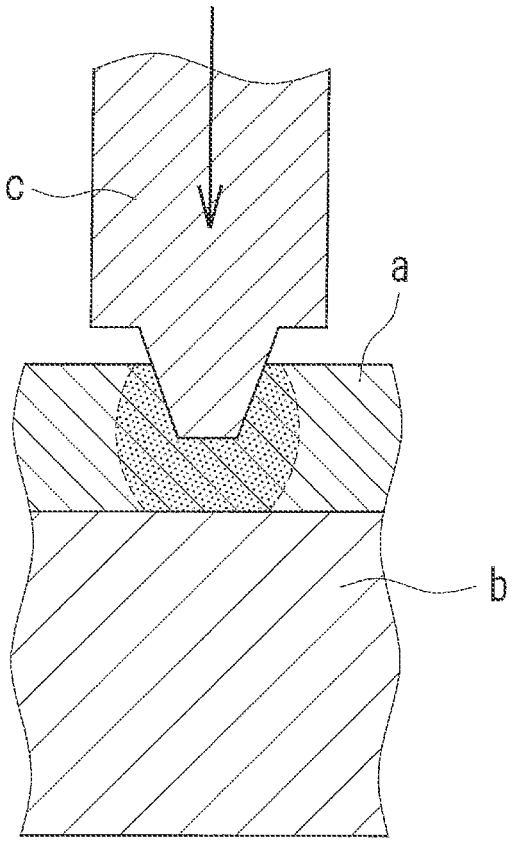
FIG. 10 RELATED ART
FIG. 10 is a cross-sectional view illustrating a state where stamping work is performed on a body panel in the related art.

FIG. 9 is a cross-sectional view partially illustrating the die seat 2 in this modified example (a view corresponding to FIG. 5). As shown in this FIG. 9, each of the dents 22 in this modified example is formed as a dent with an arcuate cross section.

The same operational effects (that the applied pressure required to obtain the stamped character in the stamped depth that is equal to or greater than the specified dimension can be set low, and that wear or breakage of the stamp character can be suppressed) as those in the above embodiment can be obtained by the die seat 2 that includes the dents 22 in such shapes. In addition, the degree of the concentration of the metal material is lowered for any of the stamped characters. Thus, the applied pressure that is required to obtain the stamped character in the stamped depth equal to or greater than the specified dimension can be set low.

Other Embodiments

The disclosure is not limited to the above embodiment and each of the above modified examples, and all modifications and applications that are included in the claims and the equivalent scope to the claims can be made to the disclosure.

For example, in the above embodiment and each of the above modified examples, the description has been made on the case where the disclosure is applied as the stamping device 1 that is used to stamp the vehicle identification number onto the body panel (the workpiece) W of the automobile formed of the high-tensile steel sheet. However, the disclosure is not limited thereto but can also be applied to a stamping device used to stamp the character or the like onto another workpiece (metal sheet). Thus, the disclosure can also be applied to a stamping device that is used to stamp the only one character onto a part. In addition, the metal sheet to be stamped is not limited to the high-tensile steel sheet but may be a general steel sheet.

In the above embodiment and each of the above modified examples, the description has been made on the case where the disclosure is applied to the stamping device 1 that is used to sequentially stamp the characters to be stamped one by one. However, the disclosure is not limited thereto but can also be applied to a stamping device used to stamp the plural characters to be stamped simultaneously.

In the above embodiment and each of the above modified examples, an arrangement mode of the dents 22 is the houndstooth check pattern. However, the disclosure is not limited thereto, and the arrangement mode of the dents 22 may be a lattice pattern.

In the above embodiment and each of the above modified examples, the stamp-receiving region B is provided in the upper surface 21 of the die seat 2, and the body panel W is placed on this upper surface 21 for the stamping work. However, the disclosure is not limited thereto. The disclosure can also be applied to such a configuration that the stamp-receiving region is provided on a lateral surface of the die seat 2 and the body panel abuts this lateral surface for the stamping work. In addition, the disclosure can also be applied to such a configuration that the stamp-receiving region is provided on a lower surface of the die seat 2 and the body panel abuts this lower surface for the stamping work.

The disclosure can be applied to the stamping device used to stamp the vehicle identification number onto the body panel by pressing the stamping punch onto the front surface of the body panel that is placed on the front surface of the die seat.

What is claimed is:

1. A stamping device comprising:

a die seat that a metal sheet, as a workpiece, abuts; and a stamping punch configured to stamp a character to be stamped onto a front surface of the metal sheet by pressing the stamping punch onto a stamped region of the metal sheet from a front surface side of the metal sheet, wherein a stamp-receiving region that corresponds to the stamped region, the stamp-receiving region being provided on a front surface of the die seat, and in the stamp-receiving region, a plurality of dents is provided in such a manner as to correspond to the stamped region of the character to be stamped, in a front view of the front surface of the die seat in a state where the metal sheet abuts the front surface of the die seat, the stamp-receiving region of the die seat is defined as a region having an outer edge that is located on an outer side of an outer edge of the stamped region by a specified dimension, a portion of the plurality of dents is provided between the outer edge of the stamp-receiving region and the outer edge of the stamped region.

2. The stamping device according to claim 1, wherein a plurality of the characters to be stamped are stamped on the front surface of the metal sheet, the stamped region of the metal sheet is a region where the plurality of the characters to be stamped is stamped.

3. The stamping device according to claim 1, wherein each of the dents has a circular shape in the front view of the front surface of the die seat, a diameter of each of the dents is smaller than half a height dimension of the character to be stamped, and the dents are arranged such that the dents that are adjacent to each other do not overlap each other.

4. The stamping device according to claim 3, wherein the diameter of each of the dents has a value that is within a range from ⅓ to 1/12 of the height dimension of the character to be stamped, and a spacing dimension between the dents that are adjacent to each other is set to have a smaller value than the diameter.

5. The stamping device according to claim 3, wherein the diameter of each of the dents has a value that is within a range from ¼ to 1/10 of the height dimension of the character to be stamped, and a spacing dimension between the dents that are adjacent to each other is set to have a smaller value than the diameter.

6. The stamping device according to claim 3, wherein each of the dents has a conical shape.

7. A stamping device comprising:

a die seat that a metal sheet, as a workpiece, abuts; and a stamping punch configured to stamp a character to be stamped onto a front surface of the metal sheet by pressing the stamping punch onto a stamped region of the metal sheet from a front surface side of the metal sheet, wherein a stamp-receiving region that corresponds to the stamped region is provided on a front surface of the die seat, in the stamp-receiving region, a plurality of dents is provided in such a manner as to correspond to the stamped region of the character to be stamped, and each of the dents has a circular shape in the front view of the front surface of the die seat, a diameter of each of the dents is smaller than half a height dimension of the character to be stamped, and the dents are arranged such that the dents that are adjacent to each other do not overlap each other, a portion of the plurality of dents is provided between the outer edge of the stamp-receiving region and the outer edge of the stamped region.

8. The stamping device according to claim 7, wherein the diameter of each of the dents has a value that is within a range from ⅓ to 1/12 of the height dimension of the character to be stamped, and a spacing dimension between the dents that are adjacent to each other is set to have a smaller value than the diameter.

9. The stamping device according to claim 7, wherein the diameter of each of the dents has a value that is within a range from ¼ to 1/10 of the height dimension of the character to be stamped, and a spacing dimension between the dents that are adjacent to each other is set to have a smaller value than the diameter.

10. The stamping device according to claim 7, wherein each of the dents has a conical shape.

* * * * *